US009689196B2

(12) United States Patent
Pemberton et al.

(10) Patent No.: US 9,689,196 B2
(45) Date of Patent: Jun. 27, 2017

(54) ASSEMBLY EQUIPMENT LINE AND METHOD FOR WINDOWS

(71) Applicant: Guardian IGU, LLC, White Bear Lake, MN (US)

(72) Inventors: Corey E. Pemberton, Prairie du Sac, WI (US); Eric B. Rapp, Avoca, WI (US); Robert J. Onesti, Oregon, WI (US); George Longo, Corsicana, TX (US)

(73) Assignee: GUARDIAN IG, LLC, Sun Prairie, WI (US)

( * ) Notice: Subject to any disclaimer, the term of this patent is extended or adjusted under 35 U.S.C. 154(b) by 751 days.

(21) Appl. No.: 14/058,481

(22) Filed: Oct. 21, 2013

(65) Prior Publication Data

US 2014/0109370 A1 Apr. 24, 2014

Related U.S. Application Data

(60) Provisional application No. 61/716,871, filed on Oct. 22, 2012.

(51) Int. Cl.
*E06B 3/673* (2006.01)

(52) U.S. Cl.
CPC ..... *E06B 3/67304* (2013.01); *E06B 3/67326* (2013.01); *E06B 3/67365* (2013.01);
(Continued)

(58) Field of Classification Search
CPC .. E06B 3/673; E06B 3/67304; E06B 3/67313; E06B 3/67317; E06B 3/67356;
(Continued)

(56) References Cited

U.S. PATENT DOCUMENTS 32,436 A 5/1861 Scofield
367,236 A 7/1887 Eeinhaedt
(Continued)

FOREIGN PATENT DOCUMENTS

CA 1290624 10/1991
DE 6903785 1/1969
(Continued)

OTHER PUBLICATIONS

"Edgetech I.G., Super Spacer® Cushion Edge™, Decorative Glass, Foam Space . . . ", http://www.edgetechig.com/SuperSpacer/CushionEdge.aspx May 23, 2011, 1 page.
(Continued)

*Primary Examiner* — Erica E Cadugan
(74) *Attorney, Agent, or Firm* — Remarck Law Group PLC

(57) ABSTRACT

The technology disclosed herein generally relate to assembly equipment for window units. In one embodiment, a window unit assembly system is taught that has a frame component that is configured to support equipment for a window unit assembly line. A pane conveyor is supported by the frame component and is configured to move panes along the window unit assembly line. A spacer conveyor is supported by the same frame component as the pane conveyor and is configured to move spacer elements along the window unit assembly line.

14 Claims, 10 Drawing Sheets

(52) U.S. Cl.
CPC ..... *E06B 3/67313* (2013.01); *E06B 3/67321* (2013.01); *E06B 3/67369* (2013.01); *Y10T 29/5124* (2015.01); *Y10T 29/5143* (2015.01); *Y10T 29/5145* (2015.01); *Y10T 29/5196* (2015.01); *Y10T 29/5197* (2015.01); *Y10T 29/53365* (2015.01); *Y10T 29/53409* (2015.01); *Y10T 29/53413* (2015.01)

(58) Field of Classification Search
CPC ..... E06B 3/6733; E06B 3/67365–3/67386; E06B 3/67343–3/67347; Y10T 29/53539–29/53548
USPC ..... 29/822–824
See application file for complete search history.

(56) References Cited

U.S. PATENT DOCUMENTS 423,704 A 3/1890 Simpson
1,310,206 A 7/1919 Mowat
2,235,680 A 3/1941 Haven et al.
2,597,097 A 5/1952 Haven
2,618,819 A 11/1952 Goodwillie
2,708,774 A 5/1955 Seelen
3,027,608 A 4/1962 Ryan
3,045,297 A 7/1962 Ljungdahl
3,143,009 A 8/1964 Pfeiffer
3,645,121 A 2/1972 Pfeiffer et al.
3,756,060 A 9/1973 Bindernagel
3,796,080 A 3/1974 Munchbach
3,839,137 A 10/1974 Davis et al.
3,921,359 A 11/1975 Brichard et al.
3,956,998 A 5/1976 Bavetz
3,981,111 A 9/1976 Berthagen
4,002,048 A 1/1977 Pozsgay
4,027,517 A 6/1977 Bodnar
4,057,944 A 11/1977 Wyatt, Jr. et al.
4,057,945 A 11/1977 Kessler
4,080,482 A 3/1978 Lacombe
4,098,722 A 7/1978 Cairns et al.
4,113,905 A 9/1978 Kessler
4,114,342 A 9/1978 Okawa
4,222,213 A 9/1980 Kessler
4,226,063 A 10/1980 Chenel
4,244,203 A 1/1981 Pryor et al.
4,356,614 A * 11/1982 Kauferle ..... B21D 53/74 156/109
4,382,375 A 5/1983 Yamamoto et al.
4,400,338 A 8/1983 Rundo
4,408,474 A 10/1983 Hutzenlaub et al.
4,431,691 A 2/1984 Greenlee
4,499,703 A 2/1985 Rundo
4,536,424 A 8/1985 Laurent
4,551,364 A 11/1985 Davies
4,561,929 A 12/1985 Lenhardt
4,567,710 A 2/1986 Reed
4,576,841 A 3/1986 Lingemann
4,580,428 A 4/1986 Brettbacher et al.
4,654,057 A 3/1987 Rhodes
4,658,553 A 4/1987 Shinagawa
4,719,728 A 1/1988 Eriksson et al.
4,720,950 A 1/1988 Bayer et al.
4,743,336 A * 5/1988 White ..... E06B 3/6733 156/107
4,769,105 A 9/1988 Lisec
4,780,164 A 10/1988 Rueckheim et al.
4,791,773 A 12/1988 Taylor
4,808,452 A 2/1989 McShane
4,815,245 A 3/1989 Gartner
4,831,799 A 5/1989 Glover et al.
4,835,130 A 5/1989 Box
4,835,926 A 6/1989 King
4,850,175 A 7/1989 Berdan
4,854,022 A 8/1989 Lisec
4,866,967 A 9/1989 Sporenberg et al.
5,052,164 A 10/1991 Sandow
5,079,054 A 1/1992 Davies
5,080,146 A 1/1992 Arasteh
5,087,489 A 2/1992 Lingemann
5,088,258 A 2/1992 Schield et al.
5,113,678 A 5/1992 Mannaka et al.
5,120,584 A 6/1992 Ohlenforst et al.
5,167,756 A 12/1992 Lenhardt
5,182,931 A 2/1993 Noe et al.
5,209,034 A 5/1993 Box et al.
5,254,377 A 10/1993 Lingemann
5,280,832 A 1/1994 Lisec
5,290,611 A 3/1994 Taylor
5,295,292 A 3/1994 Leopold
5,302,425 A 4/1994 Taylor
5,313,762 A 5/1994 Guillemet
5,361,476 A 11/1994 Leopold
5,377,473 A 1/1995 Narayan
5,391,416 A 2/1995 Kunert
5,394,671 A 3/1995 Taylor
5,394,725 A 3/1995 Lisec
5,413,156 A 5/1995 Lisec
5,439,716 A 8/1995 Larsen
5,441,779 A 8/1995 Lafond
5,443,871 A 8/1995 Lafond
5,461,840 A 10/1995 Taylor
5,485,709 A 1/1996 Guillemet
5,512,341 A 4/1996 Newby et al.
5,514,428 A 5/1996 Kunert
5,531,047 A 7/1996 Leopold et al.
5,553,440 A 9/1996 Bulger et al.
5,564,631 A 10/1996 Leopold
5,567,258 A 10/1996 Lee et al.
5,568,714 A 10/1996 Peterson
5,573,618 A 11/1996 Rueckheim
5,581,971 A 12/1996 Peterson
5,601,677 A 2/1997 Leopold
5,617,699 A 4/1997 Thompson
5,630,306 A 5/1997 Wylie
5,644,894 A 7/1997 Hudson
5,655,282 A 8/1997 Hodek et al.
5,658,645 A 8/1997 Lafond
5,675,944 A 10/1997 Kerr et al.
5,679,419 A 10/1997 Larsen
5,705,010 A 1/1998 Larsen
5,714,214 A 2/1998 Larsen
5,759,665 A 6/1998 Lafond
5,773,135 A 6/1998 Lafond
5,775,393 A 7/1998 Kovacik
5,813,191 A 9/1998 Gallagher
5,851,609 A 12/1998 Baratuci et al.
5,855,132 A 1/1999 Cozzi
5,873,256 A 2/1999 Denniston
5,879,764 A 3/1999 Chu et al.
5,888,341 A 3/1999 Lafond
5,890,289 A 4/1999 Guillemet
6,035,602 A 3/2000 Lafond
6,079,242 A 6/2000 Allegro et al.
6,092,375 A 7/2000 Denniston
6,109,084 A 8/2000 Hutzenlaub et al.
6,115,989 A 9/2000 Boone et al.
6,131,364 A 10/2000 Peterson
6,148,890 A 11/2000 LaFond
6,158,483 A 12/2000 Trpkovski
6,183,879 B1 2/2001 Deeley
6,197,129 B1 3/2001 Zhu et al.
6,223,414 B1 5/2001 Hodek et al.
6,250,026 B1 6/2001 Thompson, Jr.
6,266,940 B1 7/2001 Reichert
6,289,641 B1 9/2001 McCandless
6,295,788 B2 10/2001 Reichert
6,345,485 B1 2/2002 Boone et al.
6,351,923 B1 3/2002 Peterson
6,355,328 B1 3/2002 Baratuci et al.
6,370,838 B1 4/2002 Evason et al.
6,415,561 B2 7/2002 Thompson, Jr.
6,477,812 B2 11/2002 Boone et al.
6,481,222 B1 11/2002 Denniston

(56) References Cited

U.S. PATENT DOCUMENTS

| | | | |
|---|---|---|---|
| 6,488,996 | B1 | 12/2002 | Ino et al. |
| 6,497,130 | B2 | 12/2002 | Nilsson |
| 6,500,516 | B2 | 12/2002 | Bourlier |
| 6,528,131 | B1 | 3/2003 | Lafond |
| 6,581,341 | B1 | 6/2003 | Baratuci |
| 6,622,456 | B2 | 9/2003 | Almasy |
| 6,686,002 | B2 | 2/2004 | Auerbach |
| 6,715,244 | B2 | 4/2004 | Boone et al. |
| 6,796,102 | B2 | 9/2004 | Virnelson et al. |
| 6,823,644 | B1 | 11/2004 | Peterson |
| 6,877,292 | B2 | 4/2005 | Baratuci et al. |
| 6,887,292 | B2 | 5/2005 | Thorwesten |
| 7,008,492 | B2 | 3/2006 | Lisec |
| 7,107,729 | B2 | 9/2006 | Baratuci et al. |
| 7,132,151 | B2 | 11/2006 | Rasmussen |
| 7,275,570 | B2 | 10/2007 | McGlinchy |
| 7,347,909 | B2 | 3/2008 | Reichert |
| 7,445,682 | B2 | 11/2008 | James et al. |
| 7,448,246 | B2 | 11/2008 | Briese et al. |
| 7,827,761 | B2 | 11/2010 | Buchanan et al. |
| 7,856,791 | B2 | 12/2010 | Rosskamp et al. |
| 7,866,033 | B2 | 1/2011 | James |
| 7,901,526 | B2 | 3/2011 | James |
| 8,381,382 | B2 | 2/2013 | Wunnicke et al. |
| 8,397,780 | B2 | 3/2013 | Vianello |
| 8,474,400 | B2 | 7/2013 | McGlinchy et al. |
| 8,586,193 | B2 | 11/2013 | Rapp et al. |
| 2001/0015037 | A1 | 8/2001 | Thompson |
| 2001/0032436 | A1 | 10/2001 | Riegelman |
| 2003/0041557 | A1 | 3/2003 | Trpkovski et al. |
| 2003/0074859 | A1 | 4/2003 | Reichert et al. |
| 2003/0097818 | A1 | 5/2003 | Almasy |
| 2003/0101664 | A1 | 6/2003 | Trpkovski |
| 2003/0178127 | A1 | 9/2003 | Lisec |
| 2003/0230045 | A1 | 12/2003 | Krause et al. |
| 2005/0055901 | A1 | 3/2005 | Valentz et al. |
| 2005/0074566 | A1 | 4/2005 | Rouanet et al. |
| 2005/0166546 | A1 | 8/2005 | Reichert |
| 2005/0167028 | A1 | 8/2005 | Reichert |
| 2005/0178078 | A1 | 8/2005 | Valentz et al. |
| 2005/0227025 | A1 | 10/2005 | Baratuci et al. |
| 2006/0065345 | A1 | 3/2006 | James et al. |
| 2006/0101739 | A1 | 5/2006 | Baratuci et al. |
| 2006/0105158 | A1 | 5/2006 | Fritz et al. |
| 2006/0130427 | A1 | 6/2006 | Hodek et al. |
| 2006/0201606 | A1 | 9/2006 | Lisec |
| 2007/0077376 | A1 | 4/2007 | Mamiya et al. |
| 2007/0087140 | A1 | 4/2007 | Dierks |
| 2007/0116907 | A1 | 5/2007 | Landon et al. |
| 2007/0131338 | A1 | 6/2007 | Lisec |
| 2007/0160781 | A1 | 7/2007 | Landon et al. |
| 2007/0178256 | A1 | 8/2007 | Landon |
| 2007/0178257 | A1 | 8/2007 | Landon |
| 2009/0120018 | A1 | 5/2009 | Trpkovski |
| 2009/0120019 | A1 | 5/2009 | Trpkovski |
| 2009/0120035 | A1 | 5/2009 | Trpkovski |
| 2009/0120036 | A1 | 5/2009 | Trpkovski |
| 2009/0123694 | A1 | 5/2009 | Trpkovski |
| 2009/0223150 | A1 | 9/2009 | Baratuci et al. |
| 2009/0301637 | A1 | 12/2009 | Reichert |
| 2010/0065580 | A1 | 3/2010 | McGlinchy |
| 2010/0200164 | A1 | 8/2010 | Lisec |
| 2010/0255224 | A1 | 10/2010 | Gubbels et al. |
| 2011/0104512 | A1 | 5/2011 | Rapp et al. |
| 2012/0011722 | A1 | 1/2012 | Briese |
| 2012/0151857 | A1 | 6/2012 | Heikkila et al. |
| 2012/0177827 | A1 | 7/2012 | Trpkovski |
| 2012/0266455 | A1 | 10/2012 | Schuler et al. |
| 2013/0042552 | A1 | 2/2013 | Trpkovski |

FOREIGN PATENT DOCUMENTS

| | | | |
|---|---|---|---|
| DE | 1904907 | | 6/1971 |
| DE | 2352835 | A | 5/1975 |
| DE | 3529434 | | 2/1986 |
| DE | 102009048642 | A1 * | 3/2011 |
| EP | 0054251 | | 6/1982 |
| EP | 0056762 | A | 7/1982 |
| EP | 0 268 886 | | 6/1988 |
| EP | 0 403 058 | | 12/1990 |
| EP | 2177703 | | 4/2010 |
| FR | 2525314 | | 10/1983 |
| GB | 1508778 | | 4/1978 |
| GB | 1579726 | | 11/1980 |
| GB | 2 181 773 | | 4/1987 |
| GB | 2389138 | | 12/2003 |
| WO | WO-2004009944 | | 1/2004 |
| WO | WO-2009064905 | | 5/2009 |
| WO | WO-2009064909 | | 5/2009 |
| WO | WO-2009064915 | | 5/2009 |
| WO | WO-2009064919 | | 5/2009 |
| WO | WO-2009064921 | | 5/2009 |
| WO | WO-2011008860 | | 1/2011 |

OTHER PUBLICATIONS

International Search Report and Written Opinion mailed Jan. 22, 2009, International Application No. PCT/US2010/083441, corresponding to U.S. Appl. No. 12/270,289 (10 pages).

International Search Report and Written Opinion mailed Jan. 22, 2009, International Application No. PCT/US2008/083449, corresponding to U.S. Appl. No. 12/270,362 (8 pages).

International Search Report and Written Opinion mailed Jan. 22, 2009, International Application No. PCT/US2008/083435, corresponding to U.S. Appl. No. 12/270,393 (7 pages).

"Replacement Window Spacers: The Swiggle Spacer System", http://www.replacement-windows.com/spacers-swiggle-system.php (downloaded from web site Oct. 10, 2011) 2 pages.

"File History", for co-owned U.S. Appl. No. 12/270,362, entitled "Sealed Unit and Spacer with Stabilized Elongate Strip", filed Nov. 13, 2008 (190 pages).

"File History" for co-owned U.S. Appl. No. 12/270,393, Entitled "Material with Undulating Shape," filed Nov. 13, 2008 (203 pages).

"File History" for co-owned U.S. Appl. No. 12/270,289, Entitled "Reinforced Window Spacer," filed Nov. 13, 2008 (300 pages).

"Intercept® Spacer Technologies: Your Best Answer to Energy Star® and EN-1279, GED Integrated Solutions,", http://www.gedusa.com/intercept.php (Jun. 28, 2011 9:08:36 AM), 2 pages.

"International Search Report and Written Opinion", in co-pending Application PCT/US2011/039994, dated Nov. 17, 2011, (15 pages).

"PCT Notification Concerning Transmittal of International Preliminary Report on Patentability", from International Application No. PCT/US2008/083435, corresponding to U.S. Appl. No. 12/270,393, issued May 18, 2010, pp. 1-6.

"PCT Notification Concerning Transmittal of International Preliminary Report on Patentability", from International Application No. PCT/US2008/083441, corresponding to U.S. Appl. No. 12/270,289, issued May 18, 2010, pp. 1-8.

"PCT Notification Concerning Transmittal of International Preliminary Report on Patentability", from International Application No. PCT/US2008/083449, corresponding to U.S. Appl. No. 12/270,362, issued May 18, 2010, pp. 1-7.

"PCT Notification Concerning Transmittal of International Preliminary Report on Patentability", from International Application No. PCT|US2011/039994, corresponding to, mailed Dec. 20, 2012, pp. 1-10.

Response to Communication pursuant to RUle 161(1) and Rule 162 EPC dated Feb. 19, 2013, from co-owned, co-pending EP Patent Application 11727084.3 filed on Jun. 7, 2013 (15 pages).

Figures from AT379860 (1 page).

Figures from DE1259823 (2 pages).

Translated Abstract and Figures for CH630993A5 (2 pages).

Translated Abstract and Figures for DE19642669 (4 pages).

Translated Abstract and Figures for DE20200349 (2 pages).

Translated Abstract and Figures for DE4101277 (13 pages).

Translated Abstract and Figures for EP0139262 (3 pages).

Translated Abstract and Figures for EP0500483 (3 pages).

Translated Abstract and Figures for FR2744165 (3 pages).

(56) References Cited

OTHER PUBLICATIONS

Translated Abstract and Figures for WO03074830 (5 pages).
PCT International Search Report and Written Opinion dated Jan. 29, 2014 for PCT International Application No. PCT/US2013/066167 (8 pages).

* cited by examiner

ASSEMBLY EQUIPMENT LINE AND METHOD FOR WINDOWS

RELATED APPLICATIONS

This application is a non-provisional of "ASSEMBLY EQUIPMENT LINE AND METHOD FOR WINDOWS," U.S. Ser. No. 61/716,871, filed Oct. 22, 2012, which is incorporated herein by reference in its entirety.

This application is related to the following U.S. patent applications: "TRIPLE PANE WINDOW SPACER, WINDOW ASSEMBLY AND METHODS FOR MANUFACTURING SAME", U.S. 2012/0151857, filed Dec. 15, 2011, now U.S. Pat. No. 9,228,389; "SEALED UNIT AND SPACER", U.S. 2009/0120035, filed Nov. 13, 2008, now U.S. Pat. No. 8,596,024; "BOX SPACER WITH SIDEWALLS", U.S. 2009/0120036, filed Nov. 13, 2008, now U.S. Pat. No. 8,151,542; "REINFORCED WINDOW SPACER", U.S. 2009/0120019, filed Nov. 13, 2008; "SEALED UNIT AND SPACER WITH STABILIZED ELONGATE STRIP", U.S. 2009/0120018, filed Nov. 13, 2008; "MATERIAL WITH UNDULATING SHAPE" U.S. 2009/0123694, filed Nov. 13, 2008; and "STRETCHED STRIPS FOR SPACER AND SEALED UNIT", U.S, 2011/0104512, filed Jul. 14, 2010, now U.S. Pat. No. 8,586,193; "WINDOW SPACER APPLICATOR", U.S. 2011/0303349, filed Jun. 10, 2011, now U.S. Pat. No. 8,967,219; "WINDOW SPACER, WINDOW ASSEMBLY AND METHODS FOR MANUFACTURING SAME", U.S. Provisional Patent Application Ser. No, 61/386,732, filed Sep. 27, 2010; "SPACER JOINT STRUCTURE", US-2013-0042552-A1, filed on Oct. 22, 2012, now U.S. Pat. No. 9,187,949; "ROTATING SPACER APPLICATOR FOR WINDOW ASSEMBLY", US 2013/0047404, filed on Oct. 22, 2012, now U.S. Pat. No. 9,309,714; "SPACER HAVING A DESICCANT", U.S. 2014/0113098, filed on Oct. 21, 2013; "TRIPLE PANE WINDOW SPACER HAVING A SUNKEN INTERMEDIATE PANE", U.S. 2014/0109499, filed on Oct. 21, 2013, now U.S. Pat. No. 9,260,907, which are all hereby incorporated by reference in their entirety.

TECHNOLOGICAL FIELD

The technology disclosed herein generally relates to assembly equipment. More particularly, the technology disclosed herein relates to assembly equipment for window units.

SUMMARY

The technology disclosed herein generally relate to assembly equipment for window units. In one embodiment, a window unit assembly system is taught that has a frame component that is configured to support equipment for a window unit assembly line. A pane conveyor is supported by the frame component and is configured to move panes along the window unit assembly line. A spacer conveyor is supported by the same frame component as the pane conveyor and is configured to move spacer elements along the window unit assembly line.

In another embodiment taught herein, a window unit assembly has a frame component arranged in a window unit assembly line. A pane conveyor is supported by the frame component and is configured to move panes along the window unit assembly line in a first direction. A spacer conveyor is configured to move spacer elements along the window unit assembly line in a second direction, wherein the second direction is directly opposite to the first direction.

In yet another embodiment, the technology disclosed herein is related to a window unit assembly system that has a plurality of frame components configured to support equipment for a window unit assembly line. A plurality of pane conveyors, which are each supported by one of the frame components, are configured to move panes along the window unit assembly line. A plurality of spacer conveyors, which are each supported by one of the frame components, are configured to move spacer elements along the window unit assembly line. The plurality of frame components includes a first frame component and at least a second frame component. The first frame component supports both one of the plurality of pane conveyors and one of the plurality of spacer conveyors, and the second frame component support both another one of the plurality of pane conveyors and another one of the plurality of spacer conveyors.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

A series of machines and arrangement of those machines is described herein that will allow window manufacturers to save valuable floor space while manufacturing window assemblies by combining the processing of both the panes of glazing materials, such as glass panes, and spacer materials on a single assembly line structure. In one embodiment, the panes are loaded and processed using pane conveyers while the spacer is loaded and processed using spacer conveyors, and the spacer conveyors are mounted on the same frame elements as the pane conveyors. As a result, a separate line for processing the spacer is not required and valuable floor space is conserved. Also, separate frame elements are not required, so the cost of the assembly equipment is reduced. In one embodiment, the spacer conveyors are mounted below the pane conveyors.

In one embodiment, the spacer conveyors move the spacer in a first direction along the assembly line during processing, while the pane conveyors move the panes in a second opposite direction along the assembly line during processing. In one embodiment, the second direction is 180 degrees from, or directly opposite to, the first direction. The panes and the spacer are transferred along the assembly line, in opposite directions, until they meet at a spacer application unit, which attaches a spacer to at least one pane.

The basic structure of a window assembly will now be described in more detail with reference to FIGS. 1, 2 and 3.

Figure 1:
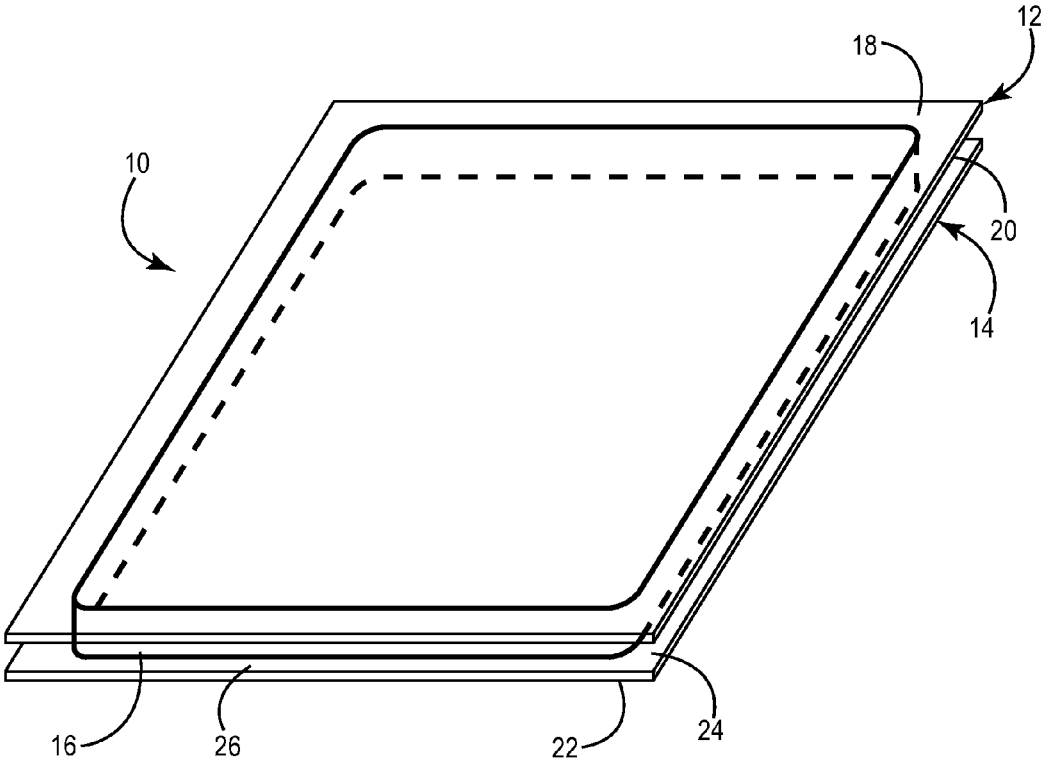
FIG. 1 is a perspective view of a window assembly.

Referring now to FIG. 1, a window assembly 10 is shown. The window assembly 10 includes a first pane 12, a second pane 14 and a spacer 16 disposed between the first and second panes 12, 14. In the subject embodiment, the first and second panes 12, 14 are adapted to allow at least some light to pass through the panes 12, 14. The first and second panes 12, 14 are made of a translucent or transparent material. In the subject embodiment, the first and second panes 12, 14 are made of a glass material. In another embodiment, the first and second panes 12, 14 are made of a plastic material.

Figure 2:
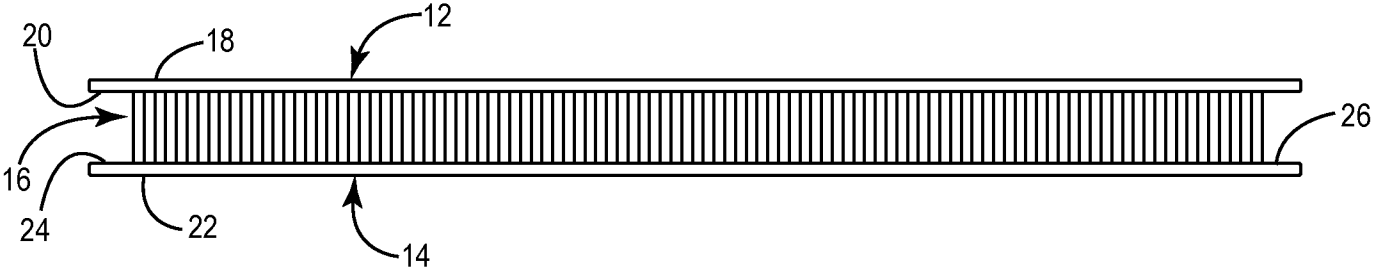
FIG. 2 is a side view of the window assembly of FIG. 1.

Referring now to FIG. 2, the first pane 12 includes a first surface 18 and an oppositely disposed second surface 20. The second pane 14 includes a first surface 22 and an oppositely disposed second surface 24.

The spacer 16 is disposed between the first and second panes 12, 14 to keep the first and second panes 12, 14 spaced apart from each other. The spacer 16 is shaped into a spacer frame. The spacer 16 is adapted to withstand compressive forces applied to the first and second panes 12, 14 and to maintain a desired space between the first and second panes 12, 14.

The spacer 16 is sealingly engaged to each of the first and second panes 12, 14 at an edge portion 26 of each of the first and second panes 12, 14. The edge portion 26 is adjacent to the outer perimeter of the panes. In the depicted embodiment, the spacer 16 is sealingly engaged to the second surface 20 of the first pane 12 and the second surface 24 of the second pane 14.

FIGS. 1 and 2 illustrate one possible embodiment of a window assembly unit that can be manufactured using the methods and equipment described herein. However, other window assembly units could also be made using the methods and equipment described herein. For example, a triple pane window unit could be manufactured using many of the techniques described herein.

Figure 3:
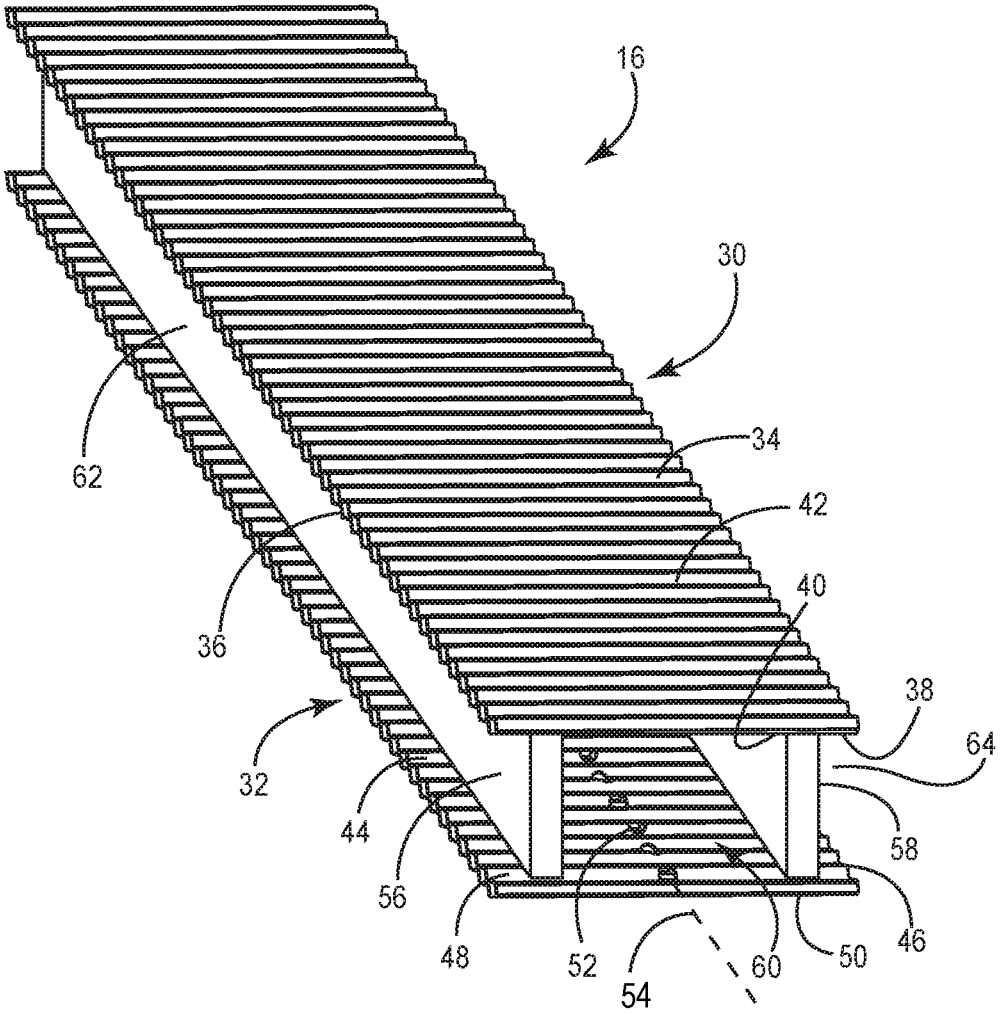
FIG. 3 is a perspective view of a spacer suitable for use with the window assembly of FIG. 1.

Referring now to FIG. 3, one embodiment of a spacer 16 is shown. Further options for a spacer suitable for use with the window assembly 10 are numerous and some have been described in the other patent applications and patents that are incorporated by reference herein.

The spacer 16 includes a first strip 30 of material and a second strip 32 of material. The first and second strips 30, 32 are generally flexible in both bending and torsion. In some embodiments, bending flexibility allows the spacer 16 to be bent to form non-linear shapes (e.g., curves). Bending and torsional flexibility also allows for ease of window manufacturing. Such flexibility includes either elastic or plastic deformation such that the first and second strips 30, 32 do not fracture during installation into window assembly 10. Some embodiments of spacer 16 include strips that do not have substantial flexibility, but rather are substantially rigid. In some embodiments, the first and second strips 30, 32 are flexible, but the resulting spacer 16 is substantially rigid.

In one embodiment, the first and second strips 30, 32 are formed from a metal material or a plastic material. In the depicted embodiment, each of the first and second strips 30, 32 has a plurality of undulations 34. The first strip 30 includes a first side portion 36 and an oppositely disposed second side portion 38. The first strip 30 further includes a first surface 40 and an oppositely disposed second surface 42. The second strip 32 includes a first side portion 44 and an oppositely disposed second side portion 46. The second strip 32 further includes a first surface 48 and an oppositely disposed second surface 50.

The second strip 32 includes a plurality of passages 52 that extend through the first and second surfaces 48, 50 of the second strip 32. In the depicted embodiment, the passages 52 are generally aligned along a central longitudinal axis 54 of the second strip 32. Other embodiments include other arrangements of passages 52, such as multiple rows of passages 52. Passages can be openings or apertures of any shape including slits, circular apertures, or the like.

The spacer 16 includes a first sidewall 56 and a second sidewall 58. The first and second sidewalls 56, 58 extend between the first strip 30 and the second strip 32. In the depicted embodiment, the first sidewall 56 is engaged to the first side portion 36 on the first surface 40 of the first strip 30 and the first side portion 44 on the first surface 48 of the second strip 32. In one embodiment, the first and second sidewalls 56, 58 extend the length of the first and second strips 30, 32.

Each of the first and second elongate strips 30, 32 includes a first elongate edge and a second elongate edge. The first elongate edge is at the edge of the first side portion 36, 44 of each strip and the second elongate edge is at the edge of the second side portion 38, 46 of each strip. The first extruded sidewall 56 is closer to the first side portion 36, 44 of each strip 30, 32 than to the second side portion 38, 46 of each strip 30, 32. The first sidewall 56 is offset from the first edge of the first elongate strip 30 and from the first edge of the second elongate strip 32 by a first offset distance. The second extruded sidewall 58 is closer to the second side portion 38, 46 of each strip 30, 32 than to the first side portion 36, 44 of each strip 30, 32. The second sidewall 58 is offset from the second edge of the first elongate strip and from the second edge of the second elongate strip by a second offset distance that will be substantially similar to the first offset distance.

In one embodiment, the first and second sidewalls 56, 58 are manufactured from a plastic material. The plastic material can be extruded, rolled or molded to form the first and second sidewall 56, 58.

The first and second strips 30, 32 and the first and second sidewalls 56, 58 cooperatively define an interior region 60 of the spacer 16. In one embodiment, a filler material is added to the interior region 60. An exemplary filler material that may be added to the interior region 60 is and/or includes a desiccant material. In the event that moisture is present between the first and second panes 12, 14 (FIGS. 1 and 2), the moisture passes through the passages 52 of the second strip 32 and is absorbed by the desiccant material in the interior region 60 of the spacer 16.

The first side portion 36 of the first strip 30, the first sidewall 56 and the first side portion 44 of the second strip 32 cooperatively define a first side 62 of the spacer 16. The second side portion 38 of the first strip 30, the second sidewall 58 and the second side portion 46 of the second strip 32 cooperatively define a second side 64 of the spacer 16. The interior region 60 is disposed between the first and second sides 62, 64 of the spacer 16.

Many additional spacer embodiments can be used with the assembly system described herein, including spacers constructed of foam, for example. The spacer embodiment of FIG. 3 is just one example of a spacer element that can be used with the assembly system described herein.

Figure 4:
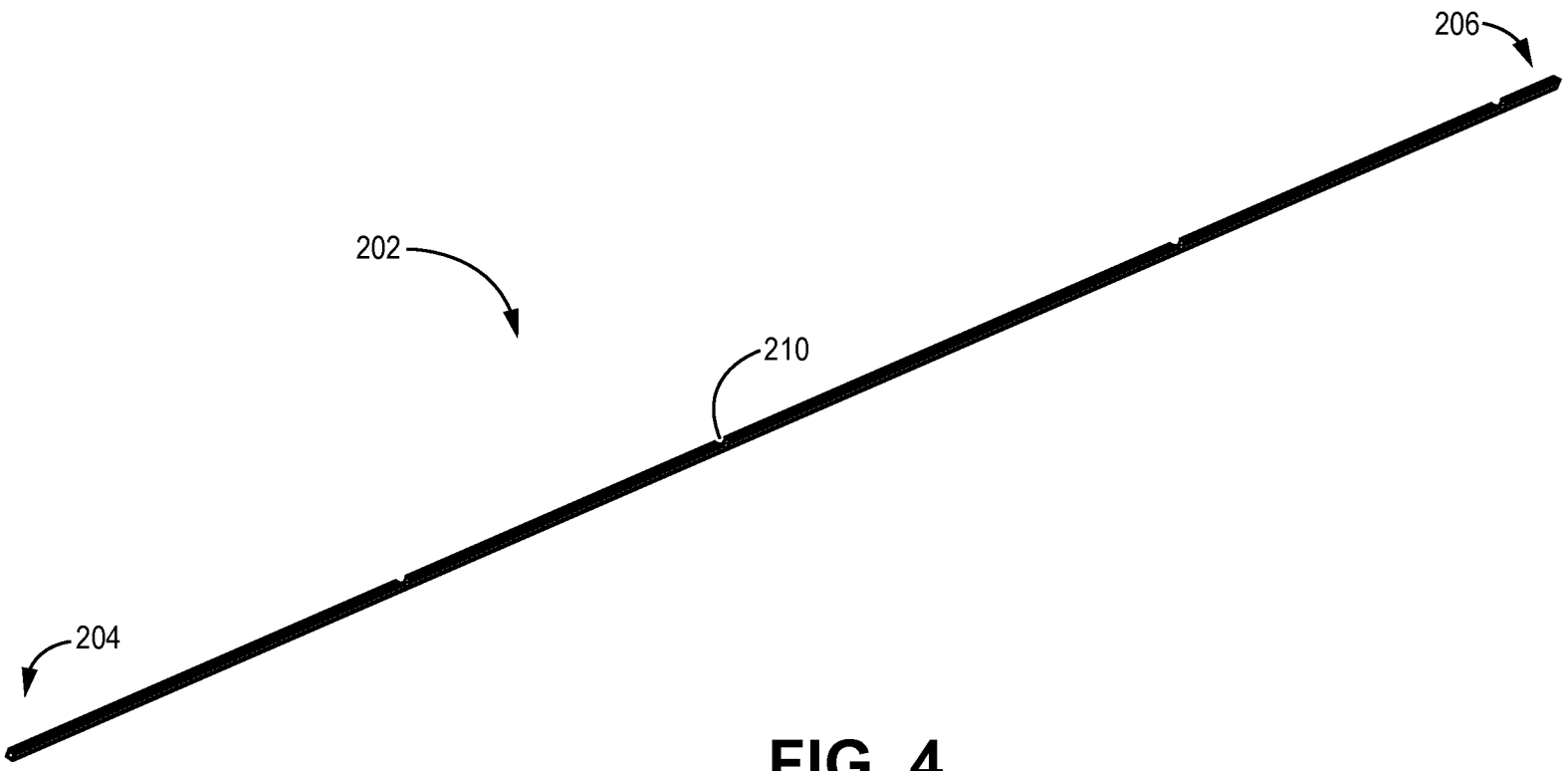
FIG. 4 is a perspective view of the spacer having a plurality of notches.
Figure 5:
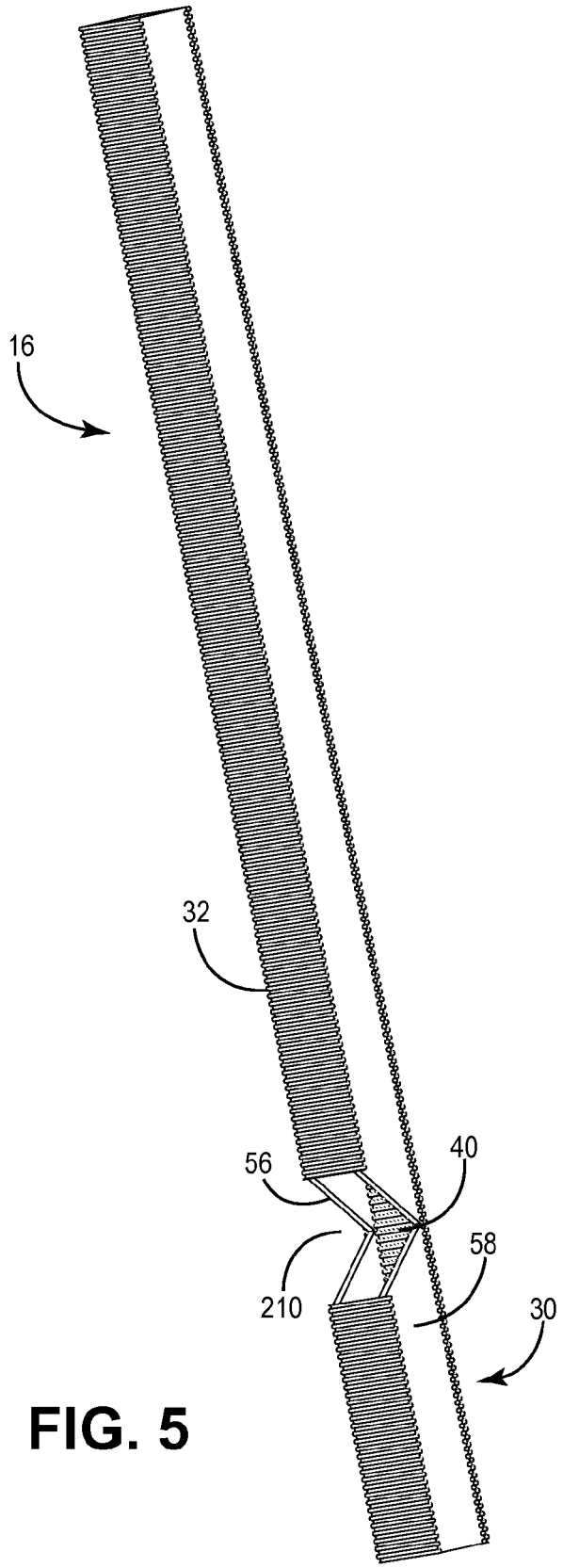
FIG. 5 is an enlarged perspective view of a portion of the spacer of FIG. 4.

In some embodiments of the window assembly system, a reeled length of spacer is provided to the assembly system coiled on a storage spool. The reeled length of spacer on the spool is much longer than is needed for assembly of each individual window unit. In one embodiment, the reeled length of spacer is continuously wrapped about the storage spool. During the window assembly process, the reeled length of spacer is unreeled and cut into discrete spacer elements 202, such as shown in FIG. 4, having a first end 204 and a second end 206. In one embodiment, each discrete spacer element 202 is sized to be bent to form a spacer frame that is adjacent to the entire perimeter of a window unit 10 (FIG. 1). In one embodiment, the spacer element 202 can include corner notches 210, as shown in FIGS. 4 and 5, to facilitate bending of the spacer element 202 at the corners of the window unit. In other embodiments, discrete spacer elements are each sized to be positioned along a single side of the window unit.

In the depicted embodiment of FIGS. 4 and 5, the notches 210 are generally V-shaped. Each notch 210 extends through the second strip 32, the first and second sidewalls 56, 58 and up to partially through the first surface 40 of the first strip 30. In the depicted embodiment, the notch 210 defines an angle that is about 90 degrees, although the angle of the corner notch 210 can have different measurements depending on the desired angle measurement of the resultant corner in the formed spacer frame.

Figure 6:
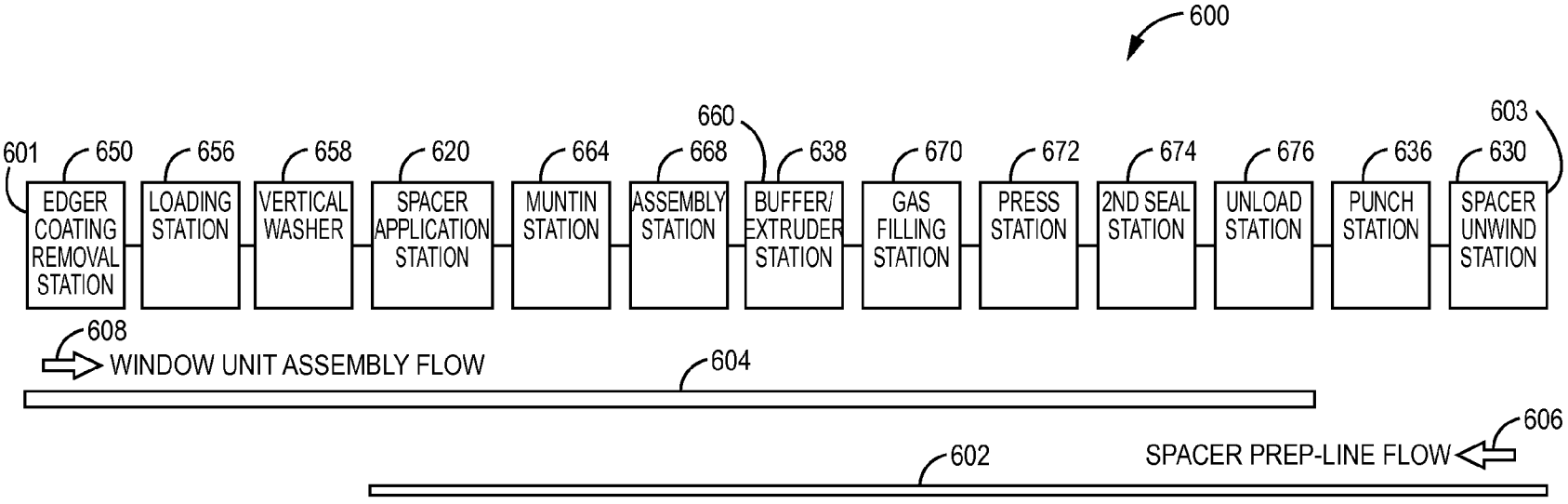
FIG. 6 is a schematic view of one embodiment of a window assembly system for assembling a window unit.

FIG. 6 is a schematic view of a series of machines arranged into a window assembly system 600. The system 600 includes many machines that can be roughly divided into two types of equipment: spacer processing equipment and window unit assembly equipment. The spacer processing equipment generally acts on the spacer element alone to prepare the spacer for incorporation into a window unit, which may also be referred to as a glazing unit. The window unit assembly equipment generally acts on the panes, joins the panes with the spacer to form subassemblies, acts on the subassemblies to form window units, and acts on the window units. The spacer processing equipment is provided with spacer conveyor elements 602 to move the spacer from machine to machine. The window unit assembly equipment is provided with pane conveyors 604 that move the panes of material from machine to machine, and then move the assembled window unit from machine to machine for further processing. Some pieces of equipment, such as the spacer application unit, could be described as both spacer processing equipment and window unit assembly equipment.

In one embodiment, the spacer conveyors 602 move the spacer in a first direction indicated by arrow 606 along the assembly line 600 during processing, while the pane conveyors 604 move the panes and window units in a second opposite direction indicated by arrow 608 during processing. In the embodiment of FIGS. 6-9, the second direction is 180 degrees from, or directly opposite to, the first direction. The panes and the spacer are transferred along the assembly line, in opposite directions, as they undergo processing steps, until they meet at a spacer application unit 620. The spacer application unit 620 assembles a discrete length of the spacer into a spacer frame and applies the spacer frame to a pane to form a pane/spacer subassembly. Then the subassembly proceeds in the second direction indicated by arrow 608 along pane conveyors 604 to undergo further processing steps.

The assembly system 600 has a first end 601 and a second end 603. In one embodiment, the panes are input at the first end 601 and the pane conveyors 604 are present at the first end 601 and continue in the second direction 608. In one embodiment, the spacers are input at the second end 603 and the spacer conveyors 606 are present at the second end 603 and continue in the first direction 606.

Figure 7:
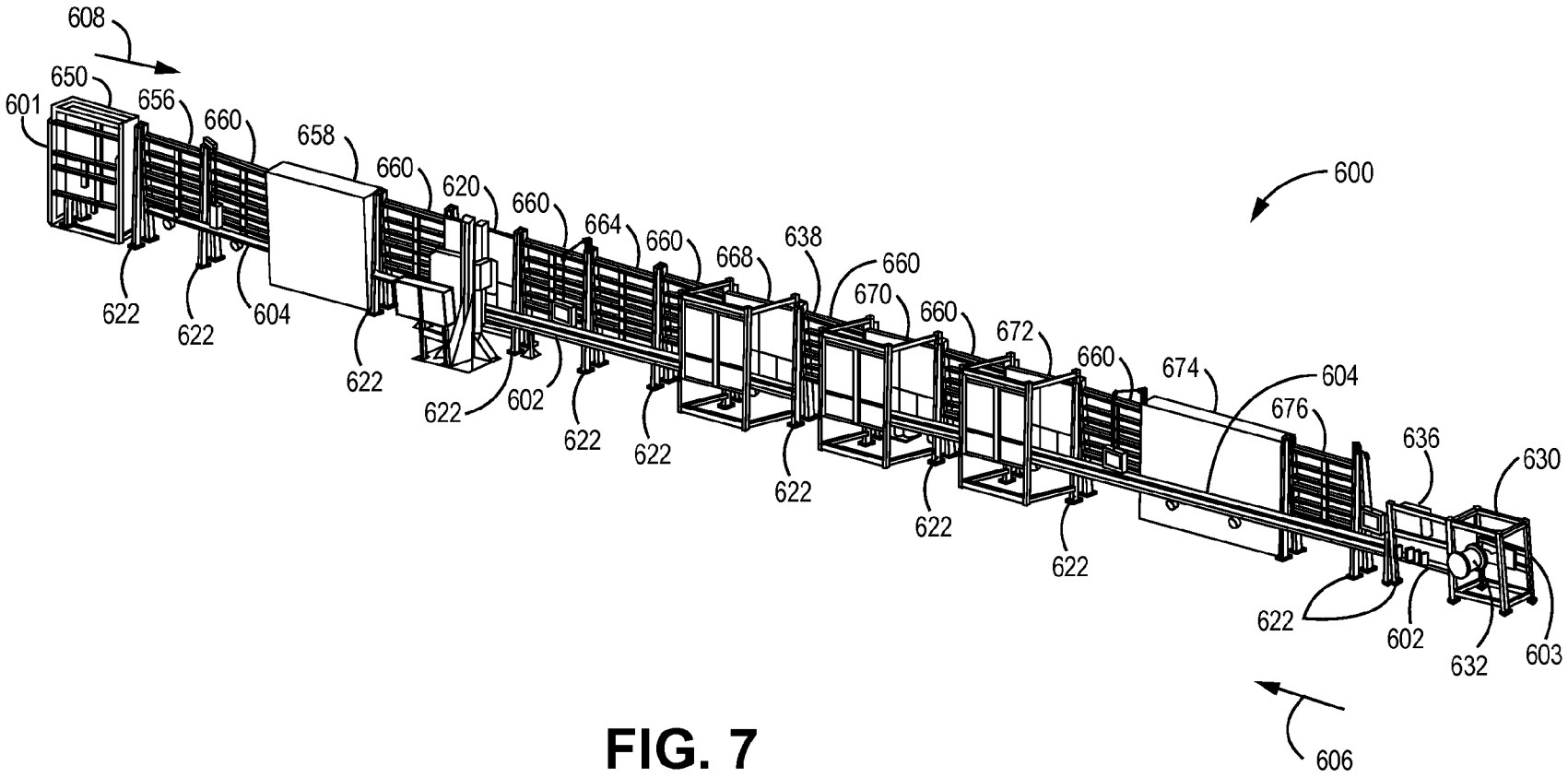
FIG. 7 is a perspective view of one embodiment of a window assembly system for assembling a window unit.

FIG. 7 is a perspective view of one embodiment of a window unit assembly system 600. The arrows 606, 608 indicating the direction of movement of the spacers and panes, respectively, are shown in FIG. 7. The spacer conveyors 602 and pane conveyors 604 are also labeled in FIG. 7, although they are small in the representation of FIG. 7. The machines of the assembly line 600 are supported by frame elements 622 shown in FIG. 7, which are positioned along the assembly line. In one embodiment, at least some of the spacer conveyors 602 and pane conveyors 604 are supported by the same frame elements 622.

Figure 8:
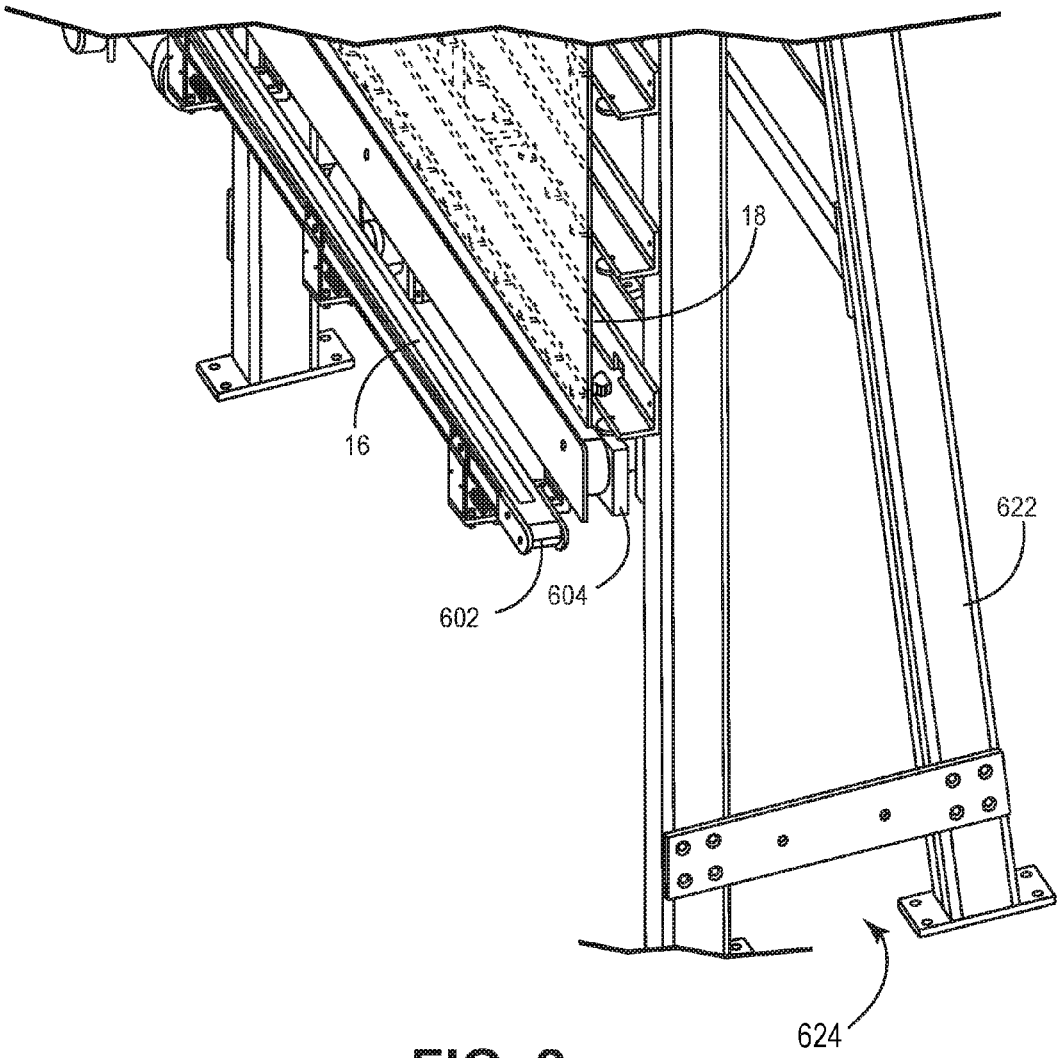
FIG. 8 is a close-up perspective view of a portion of the window assembly system of FIG. 7.

FIG. 8 shows a close up view of one portion of a frame element 622 where both a spacer conveyer 602 and a pane conveyor 604 are supported by the same frame element 622. As a result, a separate line for processing the spacer is not required and valuable space on a floor surface 624 is conserved. Also, separate frame elements are not required, so the cost of the assembly equipment is reduced. A conveyor is any type of mechanical apparatus that moves articles from place to place. One example of a conveyor that is illustrated in FIG. 8 includes two or more pulleys and a continuous loop of material that rotates around the pulleys. Many other options for conveyors may be used with the embodiments described herein.

Figure 9:
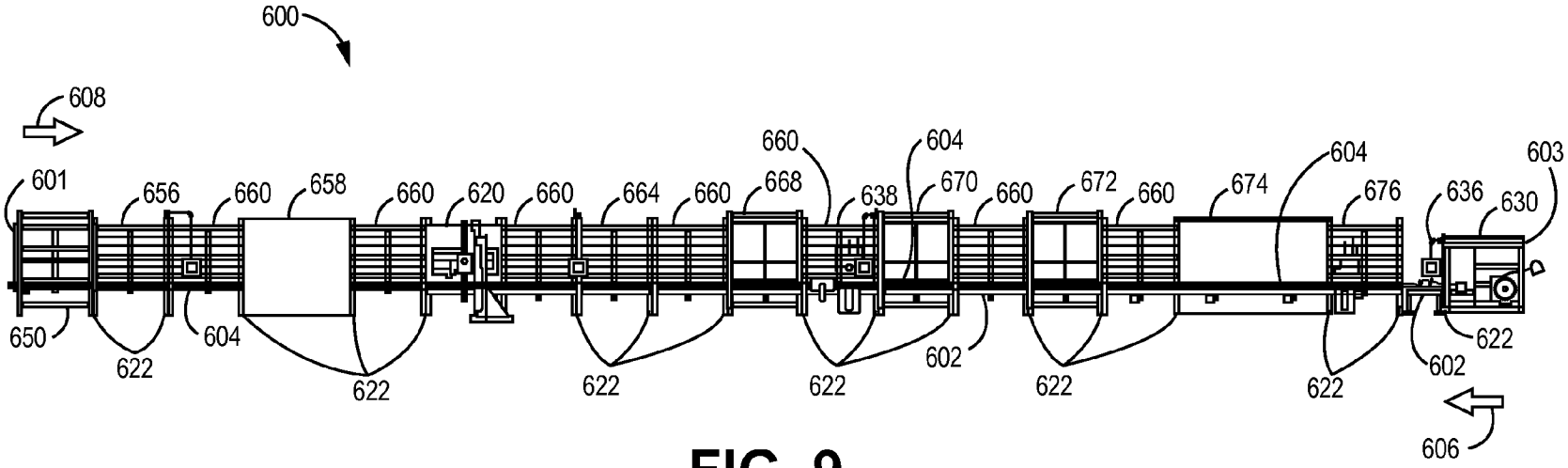
FIG. 9 is a front view of the window assembly system of FIG. 7.

In the embodiment of FIGS. 7-9, the spacer conveyors are mounted below the pane conveyors. Other arrangements are also possible, such as spacer conveyors being mounted above the pane conveyors.

FIG. 9 is a front view of the window unit assembly system 600 of FIG. 7. Now referring to FIGS. 6, 7 and 9, examples of machines included in the window assembly system 600 will now be described. However, these examples should not be considered limiting, as many different types of machines may be present on a window assembly line. The patents and patent applications incorporated herein by reference provide further examples of and further descriptions of machines that can be located in a window unit assembly system.

First, some examples of spacer processing equipment will be provided. One example of spacer processing equipment is an unwind station 630 to unwind a length of spacer from a longer reeled length of spacer on a spool 632 for incorporation into a window unit. The spacer processing equipment can also include a punching station 636 for punching corner notches into the length of spacer and for cutting the ends of the spacer length to separate the discrete spacer length from the reeled spacer. An extruder station 638 is used to extrude sealant onto the spacer, in some embodiments. For the spacer 16 shown in FIG. 3, the sealant is extruded into the cavities present at the first side 62 and the second side 64 of the spacer 16. The spacer with sealant is conveyed to the spacer application station 620. In one embodiment, the spacer application station 620 wraps the spacer around a spacer retention structure to shape the spacer into a spacer frame. The spacer frame may have a rectangular shape or another closed shape. The spacer application station 620 then applies the wrapped spacer to a pane that is present on a pane conveyor at the spacer application station 620. In some implementations, the punching station 636, the extruder station 638, and the spacer application station 620 are configured to operate simultaneously.

In one embodiment, the spacer conveyors 602 are present from a second end 603 of the system line 600 to the spacer application station 620. In the embodiment of FIGS. 6-9, the extruder station 638 is present at the same location as another piece of window unit assembly equipment, such as a buffer station 660. Both spacer conveyors 602 and pane conveyors 604 are present at the combination of the extruder station 638 and the buffer 660. In the spacer flow of the first direction 606, the extruder station 638 is upstream from the spacer application station 620 but not upstream from all the rest of the window unit assembly equipment. This aspect is in contrast with the embodiment of FIG. 10, where the extruder station 638 is upstream from all of the window unit assembly equipment.

Examples of window unit assembly equipment will now be provided, starting at one end of the assembly line and moving in the second direction indicated by arrow 608. The system 600 includes an edge coating removal station 650, where edge coatings can be removed from the panes, a loading station 656, where panes can be loaded onto a pane conveyor 604, and a vertical washer 658, where panes can be washed. Although only one is pictured in the schematic drawing of FIG. 6, the system may include several buffer conveyor units 660 that are illustrated in FIGS. 7 and 9 and may be positioned between some of the other machines. The buffer conveyor units 660 serve to hold a pane on pane conveyors 604 to be ready for the next step in the process.

The pane is delivered by pane conveyors 604 from the first end 601 of the system 600 to the spacer application station 620 where a pane is joined to a spacer frame, in one embodiment, forming a pane/spacer subassembly. The pane/spacer subassembly is moved in the second direction of arrow 608 to further processing machines. One example of such a machine is a muntin station 664, which applies muntin bars or other structures that will be located between the first and second panes to the pane/spacer subassembly, if appropriate for the window unit being assembled. The pane/spacer subassembly then moves to the assembly station 668 where the second pane is attached to the spacer to form a window unit. The window unit moves to the buffer conveyor station 660, which is held on the same frame element 622 as the sealant extruder station 638. Next the window unit moves to the gas filling station 670, which fills the space between the first and second panes with a selected gas or gas mixture. Next the window unit moves to the press station 672 where it is pressed to a specified thickness. The pressure provided at this step wets out the sealant connections within the window assembly. Then the window unit moves to the second seal station 674 where sealant is applied around the perimeter of the window unit adjacent to the spacer 16 (FIG. 1). Finally the window unit moves to the unload station 676 where the window unit can be unloaded. In one embodiment, the pane conveyors 604 are present along the system line 600 from a first end 601 to the unload station 676, and are not present at the punch station 636 or spacer unwind station 630, which are examples of spacer processing equipment.

Figure 10:
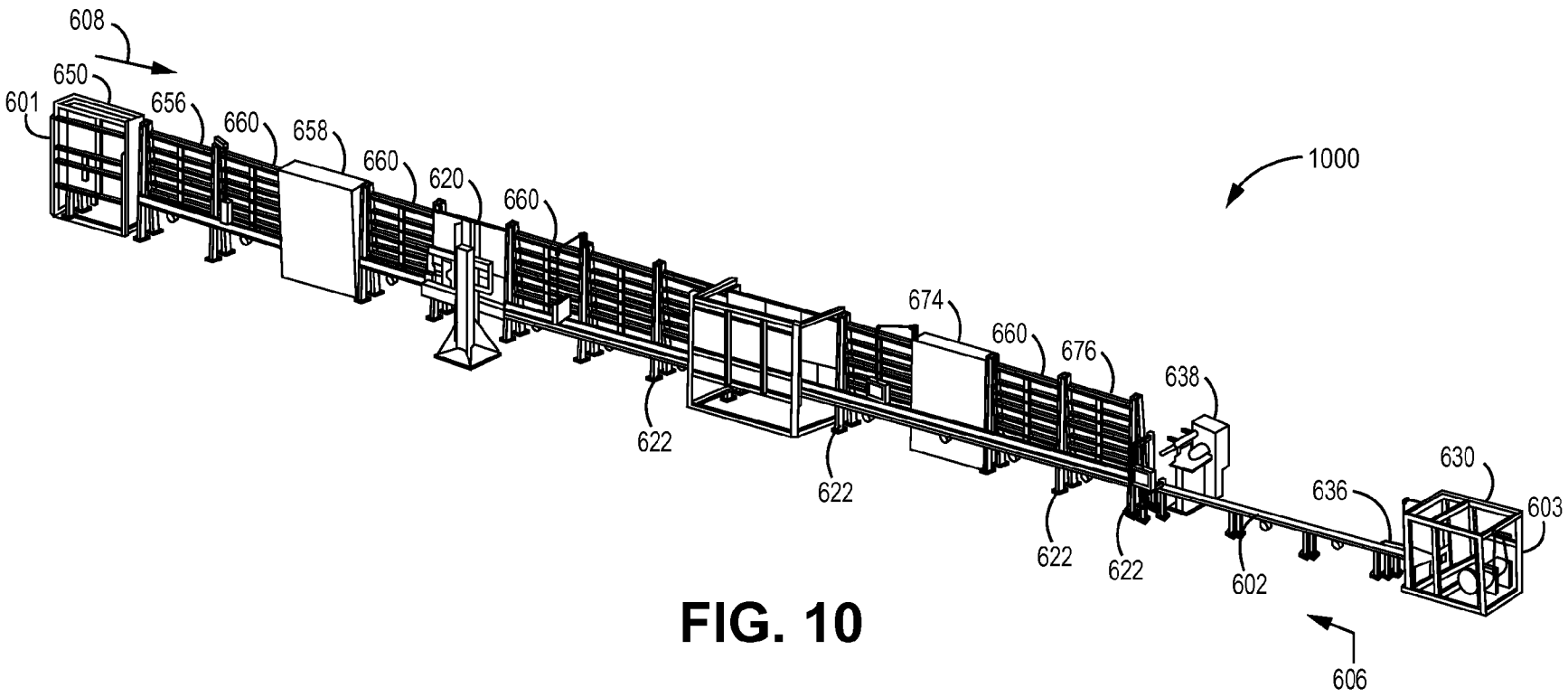
FIG. 10 is a perspective view of one embodiment of a window assembly system for assembling a window unit.

FIG. 10 illustrates an alternate embodiment 1000 of a window unit assembly system. System 1000 has many elements in common with system 600 of FIGS. 7-9, and like reference numbers are used to refer to like parts. In system 1000, the extruder station 638, which applies sealant to the spacer before it is applied to a pane, is located at a different location compared to system 600. In system 600, the extruder station 638 is located on the same frame element 622 as a buffer conveyor 660 and in between machines that are used to process the panes, subassemblies and window units. In system 600, the extruder station 638 is located between the assembly station 668 and the gas filling station 670.

In system 1000, the extruder station 638 is located at one end of a row of window unit assembly equipment machines that are used to process the panes, subassemblies and the window units. Like system 600, in system 1000 the spacer moves along spacer conveyor elements in a first direction indicated by arrow 606 while the panes, subassemblies and window units move in a second direction indicated by arrow 608. The spacer conveyors transport the spacer with sealant from the extruder station 638 to the spacer application station 620 where the spacer is shaped to form a spacer frame and applied to a pane. Like system 600, in system 1000 many of the spacer conveyors and pane conveyors are located on common frame elements 622.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A window unit assembly system comprising:

a frame component and configured to support equipment for a window unit assembly line;

a pane conveyor configured to move panes along the window unit assembly line in a first direction transversely relative to a vertical direction, wherein the pane conveyor is supported by the frame component;

a spacer conveyor configured to move a spacer along the window unit assembly line in an opposite second direction, wherein the spacer conveyor is also supported by the frame component and is arranged below the pane conveyor; and an extruder station configured to apply sealant to sides of the spacer, wherein the extruder station is also supported by the frame component.

2. The system of claim 1 further comprising a punch station configured to cut the spacer to a desired length and to cut notches in the spacer at defined corner locations;

and a spacer applicator configured to automatically shape the spacer into a spacer frame and assemble the spacer frame onto one of the panes.

3. The system of claim 2 wherein the punch station, the extruder station, and the spacer applicator are configured to operate simultaneously.

4. The system of claim 1 wherein the spacer conveyor is configured to move only the spacer along the window unit assembly line in the second direction.

5. A window unit assembly system comprising:

a frame component in a window unit assembly line;

a pane conveyor configured to move panes along the window unit assembly line in a first direction transversely relative to a vertical direction, wherein the pane conveyor is supported by the frame component;

a spacer conveyor configured to move a spacer along the window unit assembly line in a second direction, wherein the second direction is 180 degrees from the first direction; and an extruder station configured to apply sealant to sides of the spacer, wherein the extruder station is also supported by the frame component.

6. The system of claim 5 wherein the spacer conveyor is also supported by the frame component.

7. The system of claim 6 wherein the spacer conveyor is located below the pane conveyor on the frame component.

8. The system of claim 5 wherein the spacer conveyor is configured to move only the spacer along the window unit assembly line in the second direction.

9. A window unit assembly system comprising:

a plurality of frame components and configured to support equipment for a window unit assembly line;

a plurality of pane conveyors each configured to move panes along the window unit assembly line in a first direction transversely relative to a vertical direction, wherein each pane conveyor is supported by one of the plurality of frame components; and a plurality of spacer conveyors configured to move spacers along the window unit assembly line in an opposite second direction, wherein each spacer conveyor is supported by one of the plurality of frame components;

wherein the plurality of frame components includes a first frame component that supports both a first pane conveyor of the plurality of pane conveyors and a first spacer conveyor of the plurality of spacer conveyors, and wherein at least a second frame component of the plurality of frame components supports a second pane conveyor of the plurality of pane conveyors, a second spacer conveyor of the plurality of spacer conveyors, and an extruder station configured to apply sealant to sides of the spacers.

10. The system of claim 9 wherein the first frame component supports a spacer applicator configured to form a first spacer of the spacers into a spacer frame and to apply the spacer frame to a first pane of the panes.

11. The system of claim 10 wherein the second frame component also supports a buffer conveyor for the panes.

12. The system of claim 10 wherein the plurality of spacer conveyors are configured to move only the spacers along the window unit assembly line in the second direction.

13. The system of claim 9, wherein the plurality of spacer conveyors are located below the plurality of pane conveyors.

14. The system of claim 9, further comprising a storage spool having a reeled length of one of the spacers.

* * * * *